US006206661B1

(12) United States Patent
Iida et al.

(10) Patent No.: US 6,206,661 B1
(45) Date of Patent: Mar. 27, 2001

(54) HERMETIC COMPRESSOR

(75) Inventors: Noboru Iida; Kiyoshi Sawai, both of Shiga (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 0 days.

(21) Appl. No.: 09/347,916

(22) Filed: Jul. 6, 1999

(30) Foreign Application Priority Data

Jul. 8, 1998 (JP) ..... 10-208596

(51) Int. Cl.[7] ..... F04B 19/02
(52) U.S. Cl. ..... 417/462; 417/463; 417/902
(58) Field of Search ..... 417/462, 463, 417/902; 418/61.3, 161, 164, 177

(56) References Cited

U.S. PATENT DOCUMENTS 1,853,394 * 4/1932 Appel ..... 417/462
1,910,876 * 5/1933 Appel ..... 417/462 X
2,117,448 * 5/1938 Pontis et al. ..... 417/286
2,121,110 * 6/1938 Yates ..... 417/462
2,275,240 * 3/1942 Wiken ..... 417/462
2,932,255 * 4/1960 Neukirch ..... 417/462 X
3,012,515 * 12/1961 Gigh ..... 417/462
3,056,356 * 10/1962 Piper ..... 417/462
3,799,035 * 3/1974 Lamm ..... 417/462 X
3,954,355 * 5/1976 Paul, Jr. ..... 418/164 X
4,030,458 * 6/1977 Lamm ..... 417/462 X
4,137,019 * 1/1979 Hofmann ..... 417/462
4,723,895 * 2/1988 Hayase ..... 417/462 X
5,076,768 * 12/1991 Ruf et al. ..... 417/462
6,102,677 * 8/2000 Iida et al. ..... 417/463

* cited by examiner

*Primary Examiner*—John E. Ryznic
(74) *Attorney, Agent, or Firm*—Armstrong, Westerman, Hattori, McLeland & Naughton, LLP

(57) ABSTRACT

A hermetic compressor includes a compressor mechanism section 40 which includes first and second rotary cylinders 41*a* and 41*b*, and first and second pistons 42*a* and 42*b* eccentrically rotated in first and second grooves 42*a* and 43*b* in the first and second rotary cylinders 41*a* and 41*b*, upper and lower bearings 50*a* and 50*b* which clamp the first and second rotary cylinders 41*a* and 41*b*, and a casing 51. A projection, 64, a projection 66 or a recess 67 is formed on slide faces in the components of the compressor mechanism section 40, whereby the power loss due to the viscosity is reduced remarkably by reducing the sliding area of the slide faces. Thus, the efficiency of the compressor can be enhanced, and the inclination and the eccentricity of the rotary cylinder can be suppressed to the minimum.

11 Claims, 11 Drawing Sheets

HERMETIC COMPRESSOR

TECHNICAL FIELD

The present invention relates to a hermetic compressor used in a refrigeration cycle system.

BACKGROUND ART

There is a conventionally proposed principle of a compressing mechanism which includes a rotary cylinder having a groove, and a piston slidable within the groove, so that the rotary cylinder is rotated in accordance with the movement of the piston to perform suction and compression strokes (for example, see German Patent No. 863,751 and British Patent No. 430,830).

The conventionally proposed principle of the compressing mechanism will be described below with reference to FIG. 16.

The compressing mechanism is comprised of a rotary cylinder 101 having a groove 100, and a piston 102 which is slidable within the groove 100. The rotary cylinder 101 is provided for rotation about a point A, and the piston 102 is rotated about a point B.

The movements of the piston and the cylinder will be described as for a case where the rotational radius of the piston 102 is equal to the distance between the center A of rotation of the rotary cylinder 101 and the center B of rotation of the piston 102. When the rotational radius of the piston 102 is larger or smaller than the distance between the rotational center A of the rotary cylinder 101 and the rotational center B of the piston 102, different movements are performed. The description of these different movements is omitted herein.

A broken line C in FIG. 16 indicate a locus for the piston 102. FIGS. 16*a* to 16*i* show states in which the piston 102 has been rotated sequentially through every 90 degree.

First, the movement of the piston 102 will be described below.

FIG. 16*a* shows the state in which the piston 102 lies immediately above the rotational center B. FIG. 16*b* shows the state in which the piston 102 has been rotated through 90 degree in a counterclockwise direction from the state shown in FIG. 16*a*. FIG. 16*c* shows the state in which the piston 102 has been further rotated through 180 degree in the counterclockwise direction from the state shown in FIG. 16*a*. FIG. 16*d* shows the state in which the piston 102 has been further rotated through 270 degree in the counterclockwise direction from the state shown in FIG. 16*a*. FIG. 16*e* shows the state in which the piston 102 has been rotated through 360 degree in the counterclockwise direction from the state shown in FIG. 16*a* and has been returned to the state shown in FIG. 16*a*.

The movement of the rotary cylinder 101 will be described below.

In the state shown in FIG. 16*a*, the rotary cylinder 101 is located, so that the groove 100 is located vertically. When the piston 102 is moved through 90 degree in the counterclockwise direction from this state, the rotary cylinder 101 is rotated through 45 degree in the counterclockwise direction, as shown in FIG. 16*b* and hence, the groove 100 is likewise brought into a state in which it is inclined at 45 degree. When the piston 102 is rotated through 180 degree in the counterclockwise direction from the state shown in FIG. 16*a*, the rotary cylinder 101 is rotated through 90 degree in the counterclockwise direction, as shown in FIG. 16*c* and hence, the groove 100 is likewise brought into a state in which it is inclined at 90 degree.

In this way, the rotary cylinder 101 is rotated in the same direction with the rotation of the piston 102, but while the piston 102 is rotated through 360 degree, the rotary cylinder 101 is rotated through 180 degree. Therefore, to rotate the rotary cylinder 101 through 360 degree, it is necessary to rotate the piston 102 through 720 degree.

The change in volume of the groove 100 defining the compressing space will be described below.

In the state shown in FIG. 16*a*, the piston 102 lies at one end in the groove 100 and hence, only one space exists. This space is called a first space 100*a* herein. In the state shown in FIG. 16*b*, the first space 100*a* is narrower, but a second space 100*b* is produced on the opposite side of the piston 102. In the state shown in FIG. 16*c*, the first space 100*a* is further decreased into a size as small as half of the space in the state shown in FIG. 16*a*, but a second space 100*b* is of the same size as the first space 100*a*. The first space 100*a* is gradually decreased, as shown in FIG. 16*d*, and is zero in volume in the state shown in FIG. 16*e* in which the piston 102 has been rotated through 360 degree.

In this way, the first and second spaces 100*a* and 100*b* are defined in the groove 100 by the piston 102 and repeatedly varied in volume from the minimum to the maximum and from the maximum to the minimum, whenever the piston 102 is rotated through 360 degree.

Therefore, the spaces defining the compressing chambers perform the compression and suction strokes by the rotation of the piston 102 through 720 degree.

When the compressing mechanism is provided in the casing or bearing and operated, the compressing chambers are defined, so that they are surrounded by the outer peripheral surface of the piston, the wall surface of the groove in the rotary cylinder and end faces of the bearing. The surfaces of respective members defining the compressing chambers are slid on the opposed surfaces. The clearance between the slide faces is set at a small value in order to suppress the leakage of a refrigerant gas in the compressing course to the minimum, and a lubricating oil is supplied into the clearance in order to provide a lubricating effect and a sealing effect.

In such case, when two faces are rotationally slid on each other with the lubricating oil present therebetween, such as the end face of the rotary cylinder and the end face of the bearing, or the end face of the piston and the end face of the bearing, a power loss is produced due to the viscosity of the lubricating oil.

The power loss Ws due to the viscosity is represented by the following equation:

$$Ws=\pi\mu\omega^2(r_2^4-r_1^4)/(2\delta)$$

wherein $\mu$ is a viscosity coefficient of the oil; $\omega$ is a rotational angular speed; $r_2$ is an outside diameter of the slide face; $r_1$ is an inside diameter of the slide face; and $\delta$ is a distance between the slide faces. Thus, the loss Ws due to the viscosity assumes a larger value in proportion to the fourth power of the radius of the slide face.

On the other hand, the power loss Wr produced due to viscosity between the slide faces of the outer peripheral surface of the rotary cylinder and the inner peripheral surface of the casing is represented by the following equation:

$$Wr=2\pi\mu\omega^2R^3W/\delta$$

wherein R is an outside diameter of the rotary cylinder; and W is a width of the rotary cylinder. The power loss Wr assumes a value proportional to the product of the third power of the outside diameter of the rotary cylinder and the width of the rotary cylinder.

SUMMARY OF THE INVENTION

Accordingly, it is an object of the present invention to ensure that in view of the power loss produced due to the viscosity between the slide faces, the viscosity is lowered, while ensuring the sealability, and the loss in power of the compressor is reduced to enhance the compression efficiency.

To achieve the above object, according to a first aspect and feature of the present invention, there is provided a hermetic compressor, comprising compressing mechanisms provided in a casing, each of the compressing mechanisms including a rotary cylinder having a groove, and a piston slidable in the groove, so that the suction and compression are carried out by rotation of the piston on a locus of a radius E about a point spaced at a distance E apart from the center of the rotary cylinder, opposite end faces of the casing being sandwiched between bearings, wherein a recess, which does not communicate with the groove, is defined in that end face of the rotary cylinder which is a slide face relative to the bearings.

With the above arrangement, the power loss produced due to the viscosity the rotary cylinder and the bearing can be reduced by the recess, while ensuring the sealability against the outer periphery of the groove defining the compressing chamber.

According to a second aspect and feature of the present invention, in addition to the first feature, the recess is of a ring-like shape about the center of rotation of the rotary cylinder.

With the above arrangement, the recess is continuous in a direction of rotating movement and hence, the power loss due to the viscosity can be eliminated continuously in the recess. Thus, the loss in viscosity can be reduced effectively, and the formation of the recess can be easily carried out.

According to a third aspect and feature of the present invention, in addition to the second feature, the recess is defined in an outer periphery of the rotary cylinder.

With the above arrangement, by defining the recess in the outer periphery of the rotary cylinder, the power loss due to the viscosity in the outer periphery having a larger area of movement can be reduced largely.

According to a fourth aspect and feature of the present invention, there is provided a hermetic compressor, comprising compressing mechanisms provided in a casing, each of the compressing mechanisms including a rotary cylinder having a groove, and a piston slidable in the groove, so that the suction and compression are carried out by rotation of the piston on a locus of a radius E about a point spaced at a distance E apart from the center of the rotary cylinder, opposite end faces of the casing being sandwiched between bearings, wherein a projection is formed on that outer peripheral surface of the rotary cylinder, which is a slide face relative to the casing.

With the above arrangement, the power loss produced due to the viscosity in a clearance (a recess) between the rotary cylinder and the casing by the projection can be reduced, and the size of the clearance between the rotary cylinder and the casing can be minimized by the projection, whereby the inclination and eccentricity of the rotary cylinder within the casing can be suppressed to the minimum.

According to a fifth aspect and feature of the present invention, there is provided a hermetic compressor, comprising compressing mechanisms provided in a casing, each of the compressing mechanisms including a rotary cylinder having a groove, and a piston slidable in the groove, so that the suction and compression are carried out by rotation of the piston on a locus of a radius E about a point spaced at a distance E apart from the center of the rotary cylinder, opposite end faces of the casing being sandwiched between bearings, wherein a projection is formed on that inner peripheral surface of the casing, which is a slide face relative to the rotary cylinder.

With the above arrangement, the power loss produced due to the viscosity in a clearance (a recess) between the rotary cylinder and the casing by the projection can be reduced, and the size of the clearance between the rotary cylinder and the casing can be minimized by the projection, whereby the inclination and eccentricity of the rotary cylinder within the casing can be suppressed to the minimum.

According to a sixth aspect and feature of the present invention, in addition to the fourth or fifth feature, the projection is formed into a ring-like shape.

With the above arrangement, the size of the minimum clearance between the rotary cylinder and the casing can be uniformized circumferentially. Especially, the eccentricity of the rotary cylinder within the casing can be reliably prevented, and the formation of the projection can be easily carried out.

According to a seventh aspect and feature of the present invention, in addition to the sixth feature, the projection is formed at an end adjacent the bearing.

With the above arrangement, the size of the minimum clearance between the rotary cylinder and the casing can be uniformized circumferentially. Especially, the inclination of the rotary cylinder within the casing can be reliably prevented.

According to an eighth aspect and feature of the present invention, there is provided a hermetic compressor, comprising compressing mechanisms provided in a casing, each of the compressing mechanisms including a rotary cylinder having a groove, and a piston slidable in the groove, so that the suction and compression are carried out by rotation of the piston on a locus of a radius E about a point spaced at a distance E apart from the center of the rotary cylinder, opposite end faces of the casing being sandwiched between bearings, wherein a recess, which does not communicate with the groove, is defined in that end face of the piston, which is a slide face relative to the bearing.

With the above arrangement, the power loss produced due to the viscosity between the piston and the bearing can be reduced by the recess, while ensuring the sealability against the inner periphery of the groove defining a compressing chamber.

According to a ninth aspect and feature of the present invention, there is provided a hermetic compressor, comprising a plurality of compressing mechanisms provided in a casing, each of the compressing mechanisms including a rotary cylinder having a groove, and a piston slidable in the groove, so that the suction and compression are carried out by rotation of the piston on a locus of a radius E about a point spaced at a distance E apart from the center of the rotary cylinder, opposite end faces of the casing being sandwiched between bearings; and a partition plate interposed between the rotary cylinders of the adjacent compressing mechanisms, wherein a recess, which does not communicate with the groove, is defined in that end face of the piston, which is a slide face relative to the partition plate.

With the above arrangement, the power loss produced due to the viscosity between the piston and the partition plate can be reduced by the recess, while ensuring the sealability against the inner periphery of the groove defining a compressing chamber.

According to a tenth aspect and feature of the present invention, in addition to the eighth or ninth feature, the recess is formed into a ring-like shape about the center of rotation of the piston.

With the above arrangement, the recess is continuous in a direction of rotating movement and hence, the power loss due to the viscosity can be eliminated continuously in the recess. Thus, the power loss can be reduced effectively, and the formation of the recess can be easily carried out.

According to an eleventh aspect and feature of the present invention, in addition to the tenth feature, the recess is defined in an inner periphery of the piston.

With the above arrangement, the power loss due to the viscosity in the inner periphery where the movement is rapid, can be reduced largely by defining the recess in the inner periphery of the piston.

The above and other objects, features and advantages of the invention will become apparent from the following description of the preferred embodiment taken in conjunction with the accompanying drawings.

BEST MODE FOR CARRYING OUT THE PRESENT INVENTION

The present invention will now be described by way of an embodiment with reference to the accompanying drawings.

Figure 12:
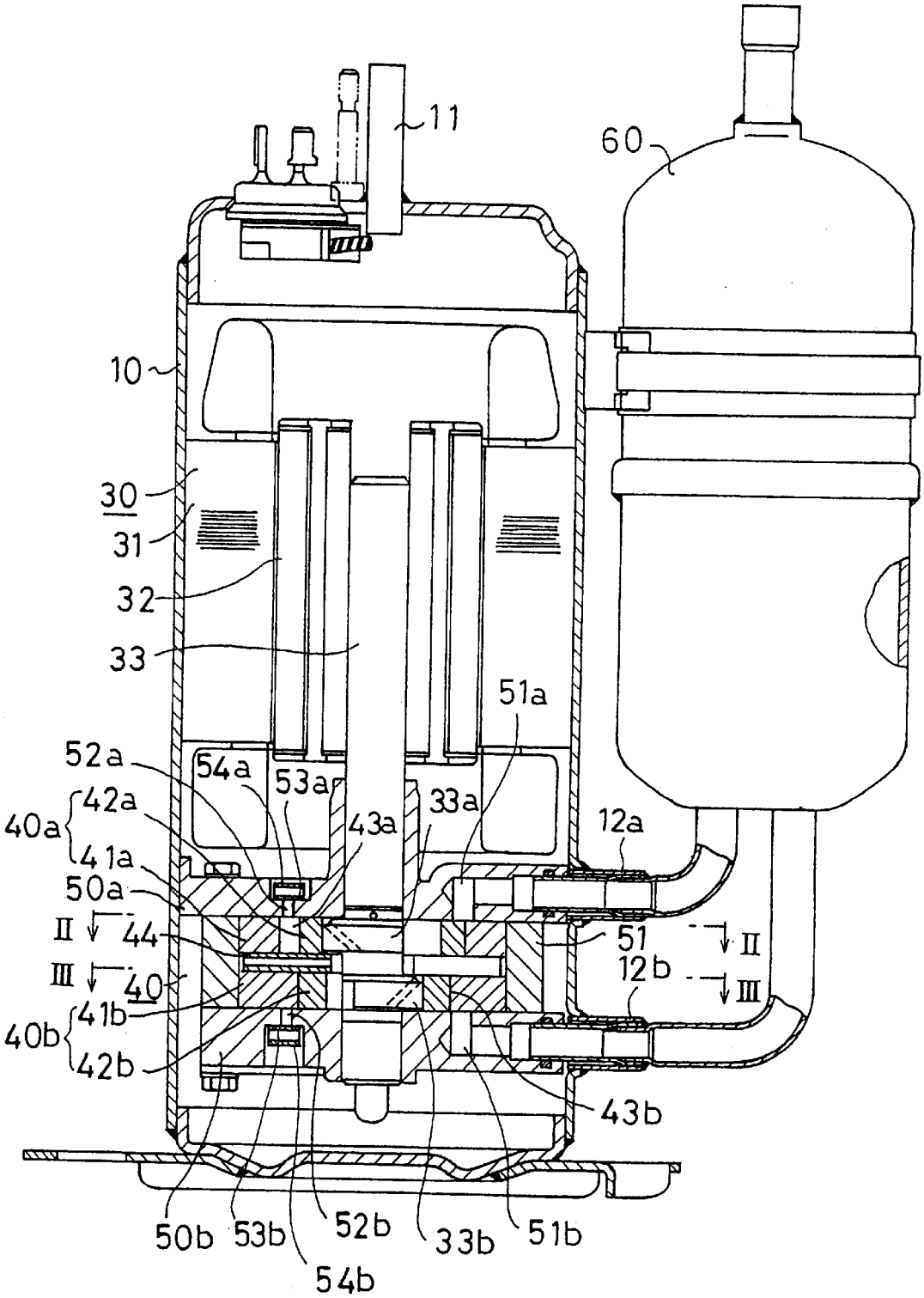
FIG. 12 is a vertical sectional view of the entire structure of the hermetic compressor according to the present invention.

Referring to FIG. 12, a hermetic compressor according to an embodiment of the present invention includes a motor 30 and a compressor mechanism section 40 within a shell 10 which constitutes a hermetic container.

The shell 10 has a discharge pipe 11 at its upper portion, and two intake pipes 12*a* and 12*b* in a side of its lower portion.

The motor 30 comprises a stator 31 fixed to the shell 10, and a rotor 32 which is rotated. The rotation of the rotor 32 is transmitted to the compressor mechanism section 40 by a shaft 33.

The compressor mechanism section 40 includes a first compressing mechanism 40*a* comprising a first rotary cylinder 41*a* and a first piston 42*a*, and a second compressing mechanism 40*b* comprising a second rotary cylinder 41*b* and a second piston 42*b*. The first rotary cylinder 41*a* has a first groove 43*a*, and the second rotary cylinder 41*b* has a second groove 43*b*. The first piston 42*a* is slidably provided in the first groove 43*a*, and the second piston 42*b* is slidably provided in the second groove 43*b*. The members constituting the first and second compressing mechanisms 40*a* and 40*b* are of the same size and shape.

The first and second compressing mechanisms 40*a* and 40*b* are partitioned from each other by a partition plate 44. The first rotary cylinder 41*a*, the second rotary cylinder 41*b* and the partition plate 44 are connected together and moved in the same manner. However, the first and second rotary cylinders 41*a* and 41*b* are connected to each other with the grooves 43*a* and 43*b* offset from each other at 90 degree, so that the phases in compressing strokes are different at 180 degree from each other.

On the other hand, the first and second pistons 42*a* and 42*b* are fitted over first and second cranks 33*a* and 33*b*, respectively. The first and second cranks 33*a* and 33*b* are provided so that their eccentric directions are different at 180 degree from each other.

The first and second compressing mechanisms 40*a* and 40*b* are sandwiched from above and below by an upper bearing 50*a* and a lower bearing 50*b* and surrounded by a tubular casing 51.

The upper bearing 50*a* is provided with an intake port 51*a* and a discharge port 52*a* for the first compressing mechanism 40*a*, and the lower bearing 50*b* is provided with an intake port 51*b* and a discharge port 52*b* for the second compressing mechanism 40*b*. Provided in the discharge ports 52*a* and 52*b* are valves 53*a* and 53*b* which are opened by a predetermined pressure, and valve stops 54*a* and 54*b* for limiting the opening movements of the valves 53*a* and 53*b*. The intake port 51*a* communicates with the intake pipe 12*a*, and the intake port 51*b* communicates with the intake pipe 12*b*. The intake pipes 12*a* and 12*b* are connected to an accumulator 60.

The flow of a refrigerant in the hermetic compressor having the above-described arrangement will be described below in brief.

The gas refrigerant within the accumulator 60 is introduced through the intake pipes 12*a* and 12*b* into the shell 10 and drawn through the intake port 51*a* and 51*b* into the first and second compressing mechanisms 40*a* and 40*b*. when the refrigerant compressed in the first and second compressing mechanisms 40*a* and 40*b* reaches a predetermined pressure, it pushes up the valves 53*a* and 53*b* and is discharged through the discharge ports 52*a* and 52*b* into the shell 10. In this case, the discharging timings in the first and second compressing mechanisms 40*a* and 40*b* are not the same as each other, because the phases are different at 180 degree from each other. The refrigerant discharged into the shell 10 is passed through an area around the motor 20 and discharged from the discharge pipe 11 provided at the upper portion of the shell 10 through an area around the motor 20 to the outside of the shell 10.

Figure 13:
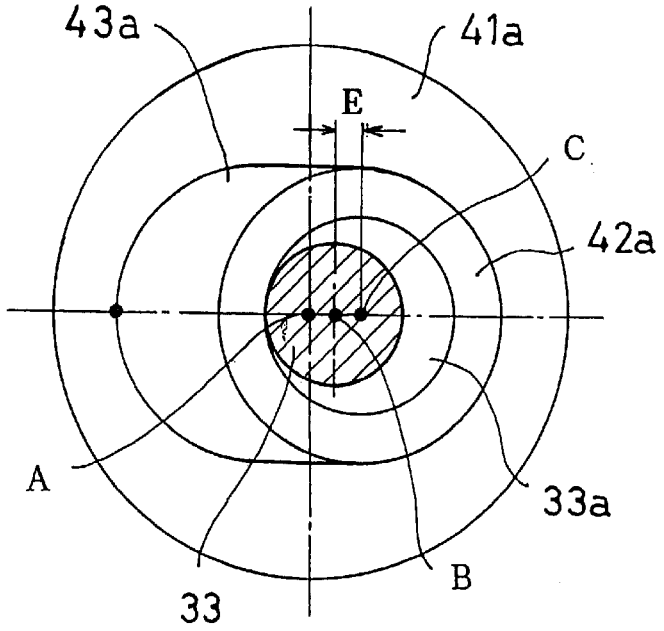
FIG. 13 is a sectional view taken along a line II—II in FIG. 12.
Figure 14:
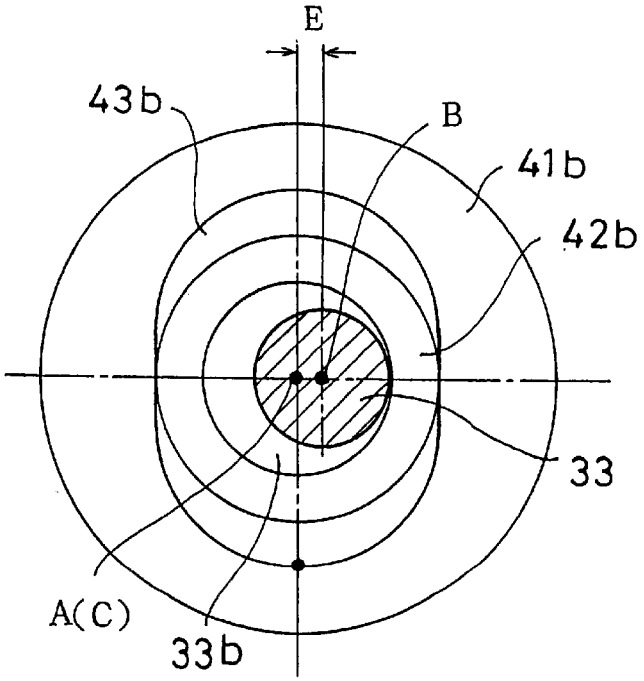
FIG. 14 is a sectional view taken along a line III—III in FIG. 12.

The relationship between the shaft 33, the first and second pistons 42*a* and 42*b* and the first and second rotary cylinders 41*a* and 41*b* in the first and second compressing mechanisms 40*a* and 40*b* will be described below with reference to FIGS. 13 and 14.

The shaft 33 adapted to transmit the rotation of the motor 30 is rotated about a point B. The center C of the cranks 33*a* and 33*b* provided on the shaft 33 is eccentric by a distance E from the center B of rotation of the shaft 33. The center C of the cranks 33*a* and 33*b* is also the center of the pistons 42*a* and 42*b*. On the other hand, the rotary cylinders 41*a* and 41*b* have the center of rotation provided by a position spaced apart at the distance E from the center B of rotation of the shaft 33. Therefore, when the center C of the crank 33*a* or the first piston 42*a* is spaced to the maximum apart from the center A of rotation of the rotary cylinder 41*a*, the largest and smallest spaces are formed in the first groove 43*a*, as shown in FIG. 13. The second compressing mechanism 40*b* has a phase difference of 180 degree from the phase of the first compressing mechanism 40*a* and hence, when the first compressing mechanism 40*a* is in a state shown in FIG. 13, the center C of the crank 33*b* or the second piston 42*b* in the second compressing mechanism 40*b* overlaps the center A of rotation of the second rotary cylinder 41*b*, as shown in FIG. 14. Therefore, the space section in the second groove 43*b* is divided into two equal spaces, as shown in FIG. 14.

The refrigerant gas sucking and compressing strokes will be described below with reference to FIG. 15.

Figure 15:
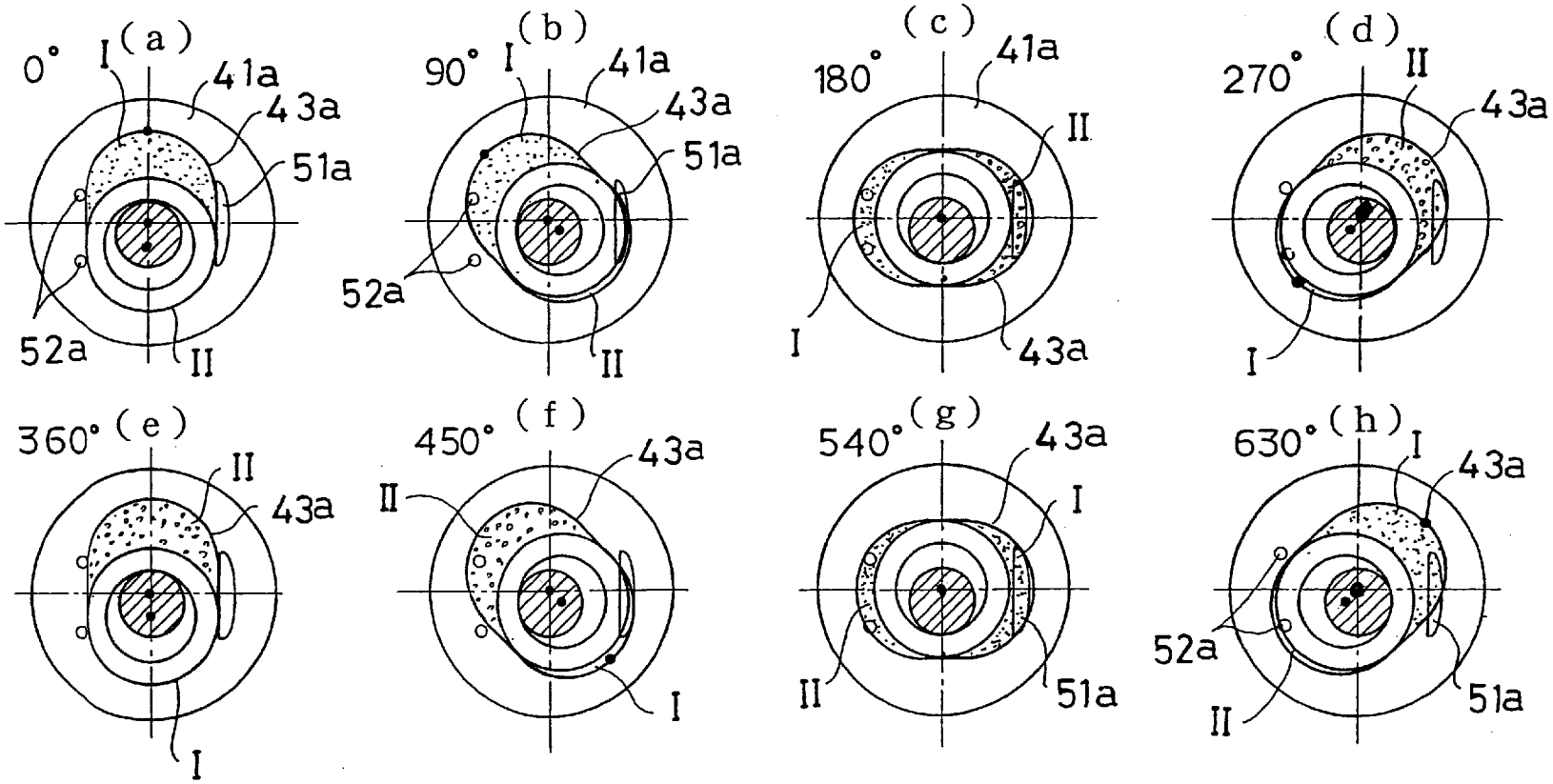
FIGS. 15*a* to 15*h* are views for explaining the operation of the hermetic compressor according to the present invention.
Figure 16:
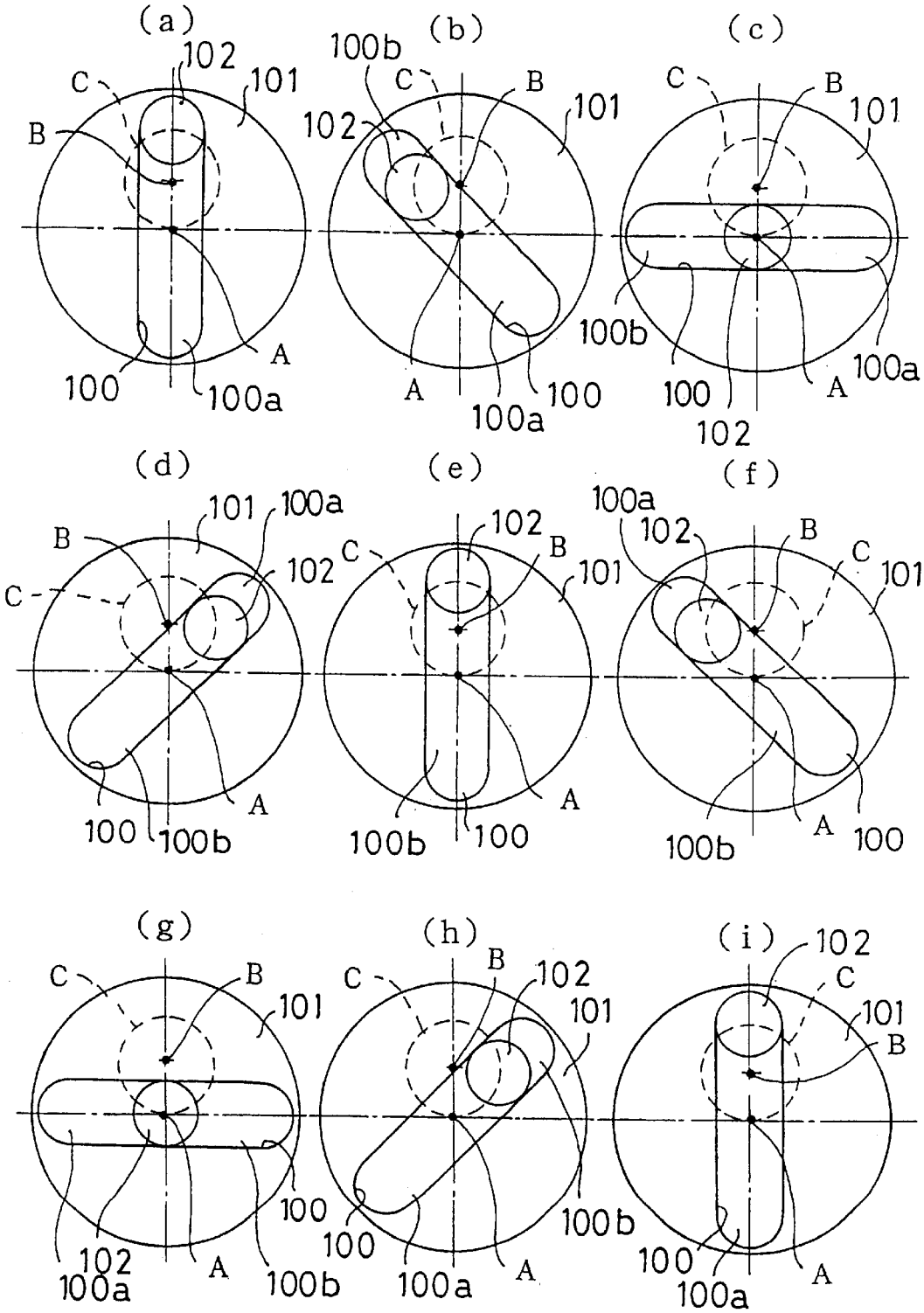
FIGS. 16*a* to 16*i* are views for explaining the principle of the compressing mechanism.

The sucking and compressing strokes in the first compressing mechanism 40*a* will be described, but the second compressing mechanism 40*b* provides the same strokes, except that the phase in FIG. 15 is different by 180 degree from that in the first compressing mechanism 40*a*.

FIGS. 15*a* to 15*h* show states in which the shaft 33 has been rotated through every 90 degree, respectively.

First, when the shaft 33 is not rotated as shown in FIG. 15*a*, the inside of the first groove 43*a* is in a state in which the space I is largest in volume, and the space II is smallest in volume.

The volume of the space I is gradually decreased from the state shown in FIG. 15*b* in which the shaft 33 has been rotated through 90 degree via the state shown in FIG. 15*c* in which the shaft 33 has been rotated through 180 degree to the state shown in FIG. 15*d* in which the shaft 33 has been rotated through 270 degree, whereby the compressed refrigerant is discharged from the discharge port 52*a*. In the space I, the compressing stroke is finished in the state shown in FIG. 15*e* in which the shaft 33 has been rotated through 360 degree.

On the other hand, the volume of the space II is gradually increased from the state shown in FIG. 15*b* in which the shaft 33 has been rotated through 90 degree via the state shown in FIG. 15*c* in which the shaft 33 has been rotated through 180 degree to the state shown in FIG. 15*d* in which the shaft 33 has been rotated through 270 degree, whereby the compressed refrigerant is sucked from the intake port 51*a*. In the space II, the sucking stroke is finished in the state shown in FIG. 15*e* in which the shaft 33 has been rotated through 360 degree.

In the states shown in FIG. 15*e* to FIG. 15*h*, the sucking stroke is carried out in the space I, and the compressing stroke is carried out in the space II. When the shaft 33 is further rotated through 90 degree from the state shown in FIG. 15*h*, the state shown in FIG. 15*a* is obtained.

In this way, the compressing and sucking strokes are carried out in the two spaces I and II defined in the first groove 43*a*, respectively, while the shaft 33 is rotated through 720 degree.

According the above-described embodiment, even if the piston is located at the center of the rotary cylinder in one of the compressing mechanisms, it is possible to avoid that the driving force from the piston does not serve as a rotational force for the rotary cylinder, because the other compressing mechanism provides a rotational force. In addition, the pistons can be disposed symmetrically by ensuring that the phase difference between the two compressing mechanisms is 180 degree, whereby the production of the hermetic compressor can be carried out easily. The freedom degree of setting of the positions of the intake port and the discharge port is increased by providing the intake port and the discharge port in the upper and lower bearings, respectively. Therefore, it is possible to regulate the compression ratio and to prevent the over-compression by the positions of the intake port and the discharge port. Further, since the phases of the first and second compressing mechanisms are different from each other by 180 degree, and the intake port in the upper bearing and the intake port in the lower bearing are provided on the same axis, the position of mounting of the intake pipe can be the same side, and a piping cannot be drawn around for connection of the intake pipe to the accumulator or the like.

The following is the description of examples for reducing the loss in viscosity between the casing 51 and the first and second rotary cylinders 41*a* and 41*b* and the first and second pistons 42*a* and 42*b* constituting the compressor mechanism section in this embodiment.

Figure 1:
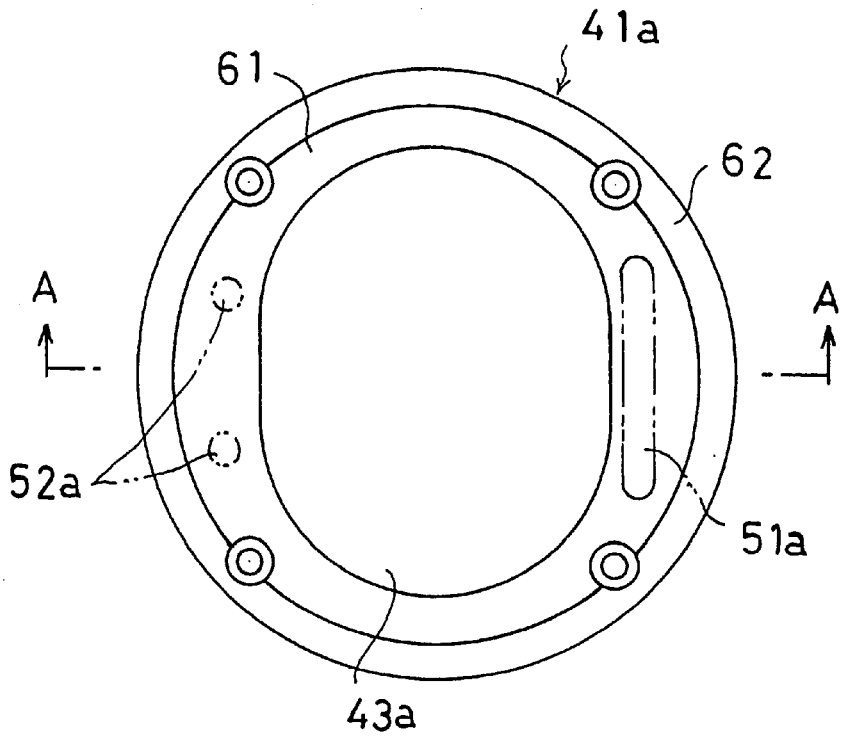
FIG. 1 is a plan view of an essential portion of an embodiment of a rotary cylinder in a hermetic compressor according to the present invention.
Figure 2:
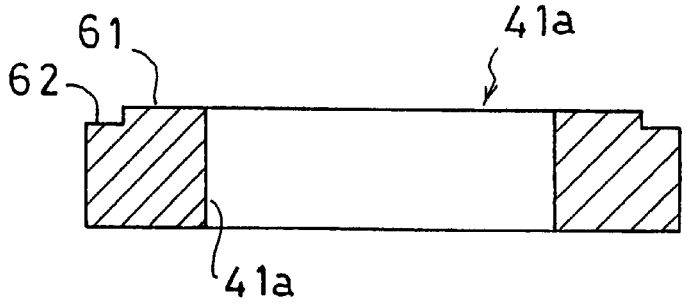
FIG. 2 is a sectional view taken along a line A—A in FIG. 1.

FIGS. 1 and 2 show an example for reducing the loss Ws in viscosity between the first and second rotary cylinder 41*a* and 41*b* and the upper and lower bearings 50*a* and 50*b*. It should be noted that FIGS. 1 and 2 show the first rotary cylinder 41*a*, but the same applies to the second rotary cylinder 41*b*. A recess 62 is defined in an end of a slide surface of the first rotary cylinder 40*a* for the upper bearing 50*a*. In this example, the recess 62 is formed by a ring-like step formed around an outer periphery of the first rotary cylinder 41*a*. The recess 62 is defined at a location where it does not communicate with the first groove 43*a* in the first rotary cylinder 40*a* and does not interfere with the intake port 51*a* and the discharge port 52*a*. Therefore, the loss Ws in viscosity between the first rotary cylinder 40*a* and the upper bearing 50*a* is remarkably reduced by the provision of the recess 62. It should be noted that the recess formed by the ring-like step is employed as the recess 62 in the example, but the recess is not limited thereto and may be recessed grooves or recessed holes disposed at a proper distance along the circumference.

Figure 3:
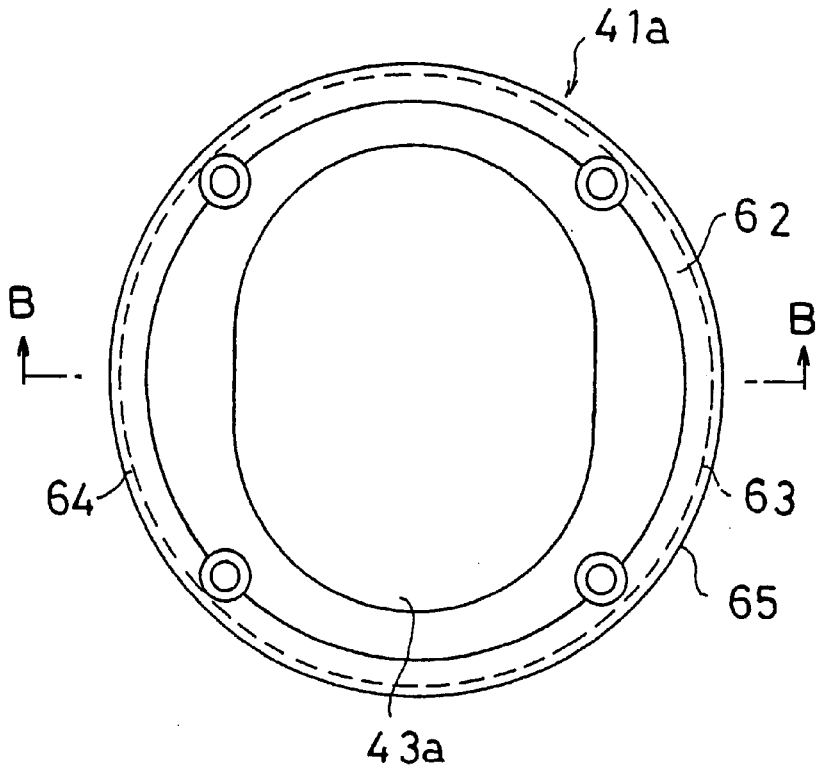
FIG. 3 is a plan view of another embodiment of a rotary cylinder in the hermetic compressor according to the present invention.
Figure 4:
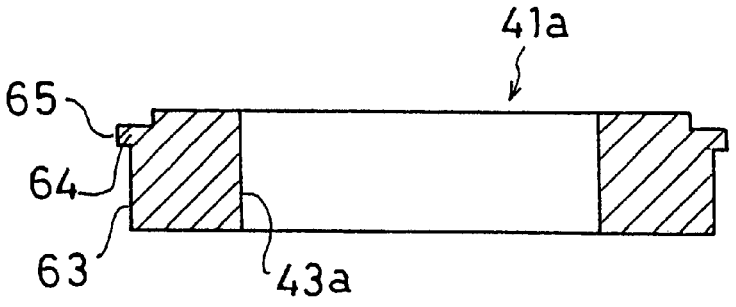
FIG. 4 is a sectional view taken along a line B—B in FIG. 3.

FIGS. 3 and 4 show an example for reducing the loss Wr in viscosity between the first rotary cylinder 41*a* (the same is true of the second rotary cylinder 41*b*) and the casing 51.

A projection 64 is formed on that outer peripheral surface of the first rotary cylinder 41*a* which is disposed in an opposed relation to an inner surface of the casing 51. In this example, only an outer peripheral surface 65 of the projection 64 is in contact with the inner surface of the casing 51. Therefore, the outer peripheral surface 63 of the first rotary cylinder 41*a* excluding the outer peripheral surface 65 is disposed at a location spaced apart from the casing 51 by a distance corresponding to the protrusion of the projection 64. Therefore, the loss Wr in viscosity can be remarkably reduced by ensuring that only the outer peripheral surface 65 of the projection 64 is in contact with the casing 51.

Figure 5:
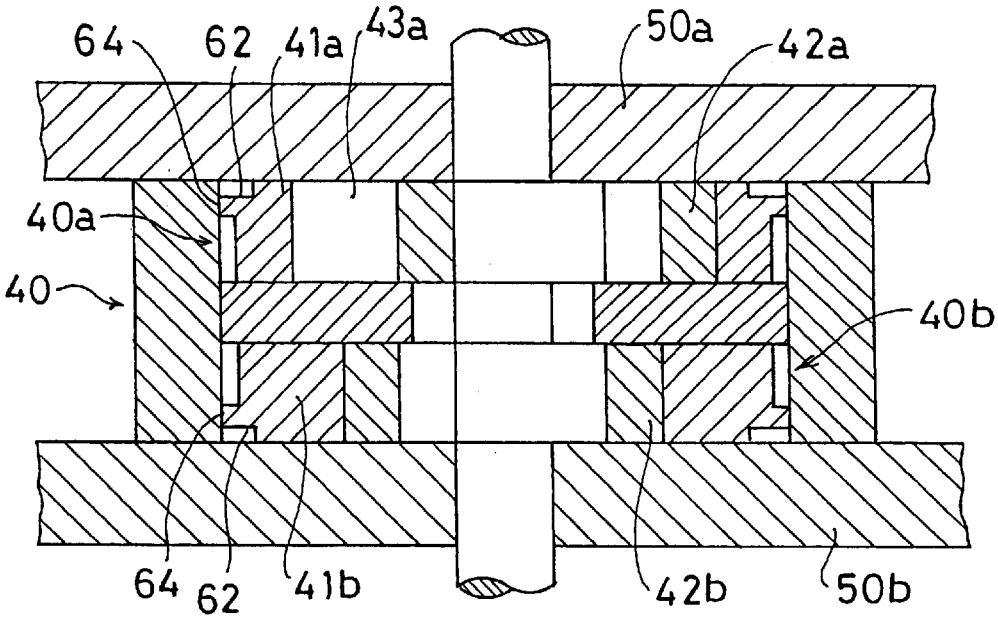
FIG. 5 is a partial sectional view showing a compressing mechanism in the hermetic compressor, in which the rotary cylinder shown in FIGS. 1 and 3 is mounted.

FIG. 5 shows the compressor mechanism section 40 using the first and second rotary cylinders 41*a* and 41*b* each provided with the recess 62 and the projection 64. In this case, the losses Ws and Wr in viscosity are remarkably reduced and hence, the efficient operation of the hermetic compressor can be carried out. The projections 64 are provided on the first rotary cylinder 41*a* at a location close to the upper bearing 50*a* and on the second rotary cylinder 41*b* at a location close to the lower bearing 50*b*. Thus, the inclination and the eccentricity of the first and second rotary cylinders 41*a* and 41*b* can be suppressed to the minimum.

Figure 6:
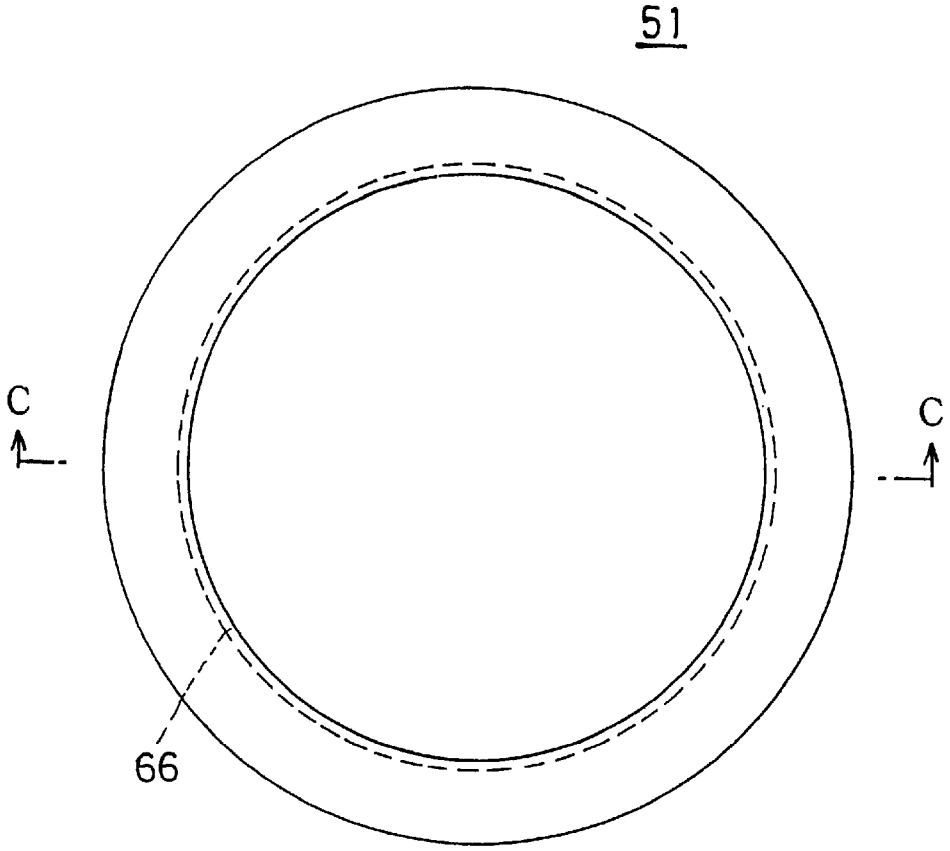
FIG. 6 is a plan view showing an embodiment of a casing in the hermetic compressor according to the present invention.
Figure 7:
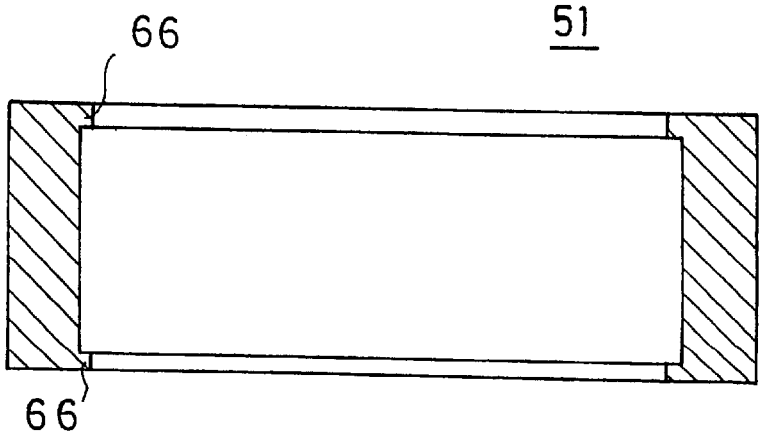
FIG. 7 is a sectional view taken along a line C—C in FIG. 6.
Figure 8:
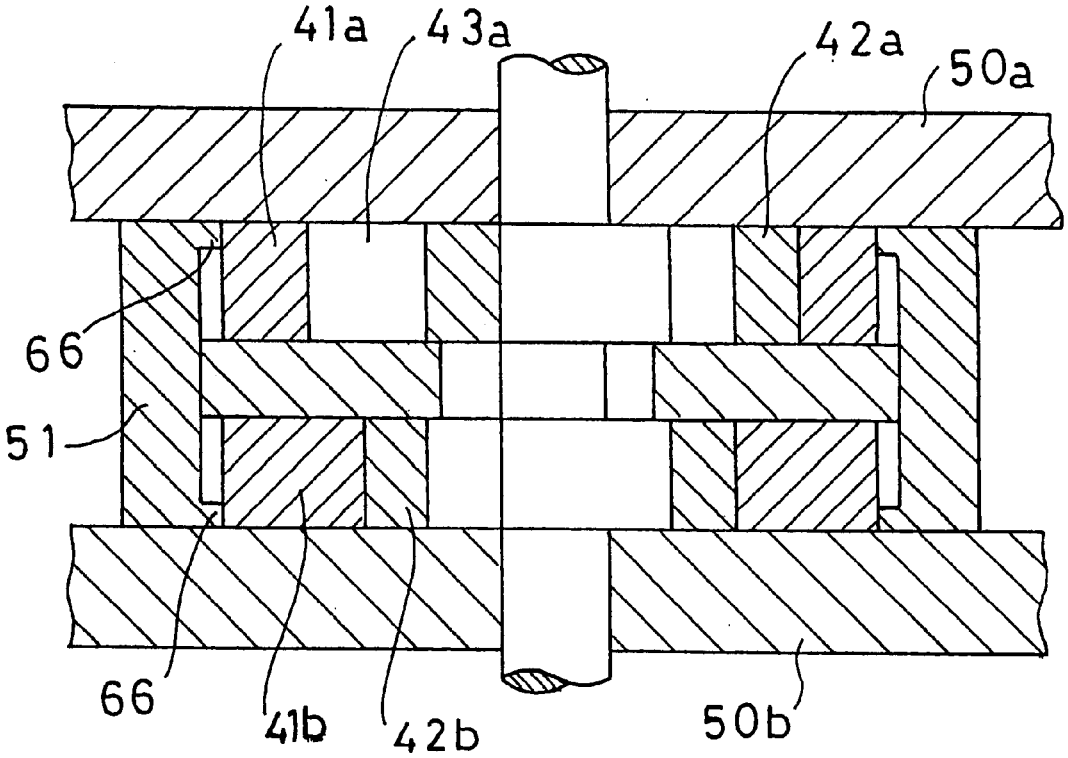
FIG. 8 is a partial sectional view showing a compressing mechanism in the hermetic compressor, in which the casing shown in FIG. 1 and the like is mounted.
Figure 9:
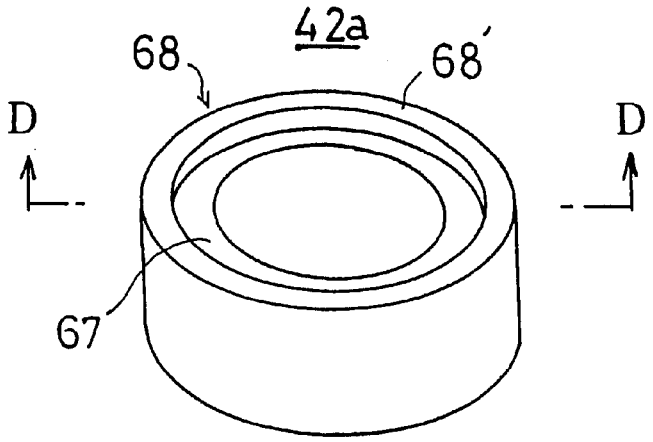
FIG. 9 is a perspective view showing an embodiment of a piston in the hermetic compressor according to the present a invention.

FIGS. 6 and 7 show an example including a projection 66 provided on the inner surface of the casing 51 for reducing the loss Wr in viscosity. FIG. 8 shows the compressor mechanism section 40 with the casing 51 provided with the projection 66 being incorporated thereinto. In FIG. 8, a recess 62 may be provided in the first rotary cylinder 41*a*. In this example, the projection 66 comprises a ring-like projection and is formed at a location close to the upper and lower bearings 50*a* and 50*b*, as shown in FIG. 8. Alternatively, the projection 66 may be discontinuous rather than of the ring-like shape. The inclination and the eccentricity of the first and second rotary cylinders 41*a* and 41*b* can be suppressed to the minimum by ensuring that the projection is provided in proximity to the upper and lower bearings 50*a* and 50*b*.

Figure 10:
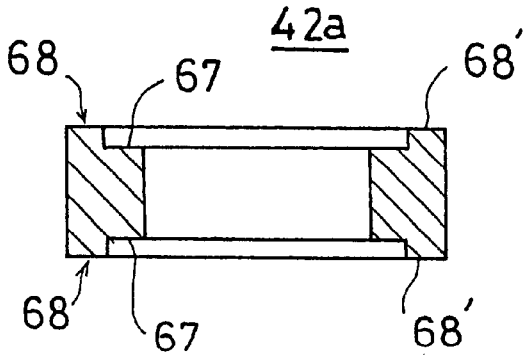
FIG. 10 is a sectional view taken along a line D—D in FIG. 9.
Figure 11:
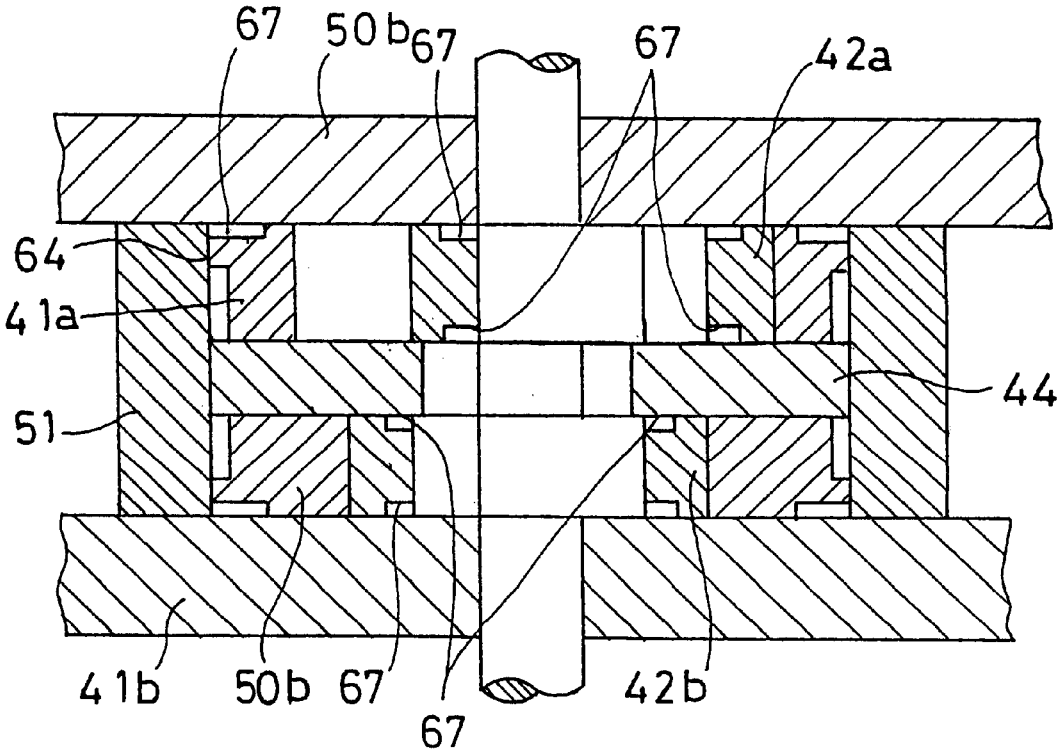
FIG. 11 is a partial sectional view showing a compressing mechanism in the hermetic compressor, in which the piston shown in FIG. 9 is mounted.

FIGS. 8 and 10 show an example including a recess 67 provided between the upper bearing 50*a* of the first piston 42*a* (the same is true of the second piston 42*b*) and the partition plate 44. The recess 67 is defined in a slide surface of the first piston 42*a* for the upper bearing 50*a* and the partition plate 44, and the upper bearing 50*a* and the partition plate 44 are in contact with each other on a slide surface 68'. In this example, the recess 67 is of a ring-like shape, but is not limited thereto and may be discontinuous. However, it is preferable that the recess 67 does not communicate with the first groove 43*a*, when it is defined in the inner periphery of the first piston 42*a*, and the first piston 42*a* is incorporated into the first rotary cylinder 41*a*. FIG. 11 shows the compressor mechanism section 40 in which the first and second piston 42*a* and 42*b* having the above-described arrangement are incorporated. The value of the loss Ws can be reduced remarkably by using the first and second pistons 42*a* and 42*b*.

The shapes of the recess 62, the projection 64 and the recess 67 are not limited those shown in Figures, and for example, a recess and a projection may be formed by an inclined surface and an arcuate surface, respectively. The number of the recesses and the projections is not limited to one. The different in phase between the two compressing mechanisms is 180 degree in the above description, but is not limited thereto and may be 90 degree or 270 degree. The present embodiment has been described about the case where only the two compressing mechanisms are provided, but the present invention is not limited to such case.

What is claimed is:

1. A hermetic compressor, comprising compressing mechanisms provided in a casing, each of said compressing mechanisms including a rotary cylinder having a groove, and a piston slidable in said groove, so that the suction and compression are carried out by rotation of said piston on a locus of a radius E about a point spaced at a distance E apart from the center of said rotary cylinder, opposite end faces of said casing being sandwiched between bearings, wherein a recess, which does not communicate with said groove, is defined in that end face of said rotary cylinder which is a slide face relative to said bearings.

2. A hermetic compressor according to claim 1, wherein said recess is of a ring-like shape about the center of rotation of said rotary cylinder.

3. A hermetic compressor according to claim 2, wherein said recess is defined in an outer periphery of said rotary cylinder.

4. A hermetic compressor, comprising compressing mechanisms provided in a casing, each of the compressing mechanisms including a rotary cylinder having a groove, and a piston slidable in said groove, so that the suction and compression are carried out by rotation of said piston on a locus of a radius E about a point spaced at a distance E apart from the center of said rotary cylinder, opposite end faces of said casing being sandwiched between bearings, wherein a projection is formed on that outer peripheral surface of said rotary cylinder, which is a slide face relative to said casing.

5. A hermetic compressor, comprising compressing mechanisms provided in a casing, each of said compressing mechanisms including a rotary cylinder having a groove, and a piston slidable in said groove, so that the suction and compression are carried out by rotation of said piston on a locus of a radius E about a point spaced at a distance E apart from the center of said rotary cylinder, opposite end faces of said casing being sandwiched between bearings, wherein a projection is formed on that inner peripheral surface of said casing, which is a slide face relative to said rotary cylinder.

6. A hermetic compressor according to claim 5, wherein said projection is formed into a ring-like shape.

7. A hermetic compressor according to claim 6, wherein said projection is formed at an end adjacent said bearing.

8. A hermetic compressor, comprising compressing mechanisms provided in a casing, each of the compressing mechanisms including a rotary cylinder having a groove, and a piston slidable in the groove, so that the suction and compression are carried out by rotation of the piston on a locus of a radius E about a point spaced at a distance E apart from the center of the rotary cylinder, opposite end faces of the casing being sandwiched between bearings, wherein a recess, which does not communicate with said groove, is defined in that end face of the piston, which is a slide face relative to said bearing.

9. A hermetic compressor, comprising a plurality of compressing mechanisms provided in a casing, each of said compressing mechanisms including a rotary cylinder having a groove, and a piston slidable in the groove, so that the suction and compression are carried out by rotation of said piston on a locus of a radius E about a point spaced at a distance E apart from the center of said rotary cylinder, opposite end faces of said casing being sandwiched between bearings; and a partition plate interposed between the rotary cylinders of the adjacent compressing mechanisms, wherein a recess, which does not communicate with the groove, is defined in that end face of the piston, which is a slide face relative to said partition plate.

10. A hermetic compressor according to claim 8 or 9, wherein said recess is formed into a ring-like shape about the center of rotation of said piston.

11. A hermetic compressor according to claim 10, wherein said recess is defined in an inner periphery of said piston.

* * * * *